US007029291B2

(12) United States Patent
Chen

(10) Patent No.: US 7,029,291 B2
(45) Date of Patent: Apr. 18, 2006

(54) CONNECTOR AND CONNECTING STRUCTURE THEREOF

(75) Inventor: Chun-Chen Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/047,267

(22) Filed: Jan. 31, 2005

(65) Prior Publication Data

US 2005/0266706 A1 Dec. 1, 2005

(30) Foreign Application Priority Data

May 31, 2004 (TW) ..... 93115546 A

(51) Int. Cl.
*H01R 12/00* (2006.01)

(52) U.S. Cl. ..... 439/79; 439/76.1

(58) Field of Classification Search ..... 439/79, 439/76.1, 63, 535, 946, 263, 80–81, 357–358, 439/680, 350, 352

See application file for complete search history.

(56) References Cited

U.S. PATENT DOCUMENTS

| | | | | |
|---|---|---|---|---|
| 5,403,207 | A * | 4/1995 | Briones | 439/620 |
| 5,772,452 | A * | 6/1998 | Aoyama | 439/74 |
| 6,220,872 | B1 * | 4/2001 | Chen | 439/76.1 |
| 6,592,392 | B1 * | 7/2003 | Po-Heng | 439/358 |
| 6,860,743 | B1 * | 3/2005 | Ekkul et al. | 439/76.1 |

* cited by examiner

*Primary Examiner*—Gary F. Pauman
*Assistant Examiner*—Edwin A. Leon
(74) *Attorney, Agent, or Firm*—Madson & Austin

(57) ABSTRACT

The connector and the connecting structure thereof includes an isolation main body having a through hole and an opening. A conducting terminal is disposed in the through hole and protrudes out of the opening. A holding element extends from one end of the conducting terminal. A connecting element has one end connected to the holding element and has the other end connected to a circuit board in an electronic device.

10 Claims, 5 Drawing Sheets

CONNECTOR AND CONNECTING STRUCTURE THEREOF

FIELD OF THE INVENTION

The present invention relates to a connector and a connecting structure thereof, and more particularly to a connector and a connecting structure thereof applied to an electronic device, such as an adapter.

BACKGROUND OF THE INVENTION

Please refer to FIGS. 1(*a*) and 1(*b*), which are schematic views showing a conventional AC connector. The conventional AC connector 10 mainly includes an isolation main body 101 having a through hole 102 formed therein, and the through hole 102 further includes a first conducting terminal 103 and a second conducting terminal 104 mounted thereinside, wherein the first conducting terminal 103 and the second conducting terminal 104 pass through openings (not shown) located at the rear of the main body 101 and are connected to a first pin 105 and a second pin 106 respectively by a welding or riveting manner. Moreover, a supporting rod with a protruding structure 107 is further mounted at the bottom of the main body 101 of the AC connector 10. Thus, through engaging the protruding structure 107 of the supporting rod with the plugging holes 111 and 112 on the circuit board 11 disposed inside the adapter, the AC connector 10 can be fixed on the circuit board 11. Besides, the first pin 105 and the second pin 106 can extend downwardly to be plugged into pin holes 113 and 114 on the circuit board 11 and then welded on the circuit board 11, so that the AC power received by the first conducting terminal 103 and the second conducting terminal 104 can be conducted to the circuit board 11.

However, the AC connector described above actually has some unavoidable defects. First of all, because the first pin and the second pin are downwardly extended into the pin holes on the circuit board, the distance between the two pin holes should be matched with that between the first and the second pins, and it is therefore disadvantageous for the AC connector to be applied to other circuit boards with different standards. Furthermore, because the first and the second pins are made of metal material and must be perpendicularly and directly plugged into the circuit board as assembling and then welded on the circuit board, the first and the second pins are actually inflexible. Therefore, they cannot eliminate the heat stress produced by electronic elements on the circuit board as being operated.

To overcome the problem of narrow applicability, a design that connects the AC connector and the circuit board inside the electronic device through a connecting wire is developed. Please refer to FIG. 2, which is a schematic view showing an AC connector in the market. As shown in FIG. 2, the AC connector 20 at least includes an isolation main body 201, a first conducting terminal 203, a second conducting terminal 204, a first conducting piece (not shown), and a second conducting piece 205, wherein a through hole 202 is formed in the main body 201 and the first conducting terminal 203 and the second conducting terminal 204 are disposed thereinside. The first conducting terminal 203 and the second conducting terminal 204 pass through openings (not shown) at the rear of the main body 201 and are connected to the first conducting piece (not shown) and the second conducting piece 205 respectively. Finally, one end of a connecting wire 206 is connected to a hole of the conducting piece 205 by welding and fixed by the solder ball, and the other end of the connecting wire 206 is connected to the circuit board inside the electronic device (not shown), so as to electrically connected the AC connector 20 and the electronic device.

Many defects existed in the conventional AC connector can be solved by means of the connecting wire used in this design and the AC connector can thus be applied to all kinds of circuit boards. However, since the connecting wire needs to be connected and fixed to the hole at the terminal of the conducting piece by welding and the connecting position is quite close to the main body of the AC connector, it is unavoidable to destroy the structure of the main body during the welding process.

Therefore, how to improve the whole structure of the AC connector for avoiding the defects described above and further reducing the manufacturing cost has become a challenge for the manufacturer.

SUMMARY OF THE INVENTION

The object of the present invention is to provide a connector and a connecting structure thereof, which uses the conducting terminal directly and the holding element to electrically connect the connector and the electronic device, to reduce the possible influences on the isolation main body of the connector caused by the welding or riveting process. On the other hand, using a connecting wire to connect the connector and the electronic device can solve the problem of narrow applicability of the connector so as to be applied to all kinds of circuit boards.

In accordance with an aspect of the present invention, the connector and the connecting structure thereof comprises an isolation main body having a through hole and an opening, at least a conducting terminal disposed in the through hole and protruding out of the opening, a holding element extended from one end of the conducting terminal, and a connecting element having one end connected to the holding element, and the other end connected to a circuit board in an electronic device.

For example, the electronic device is an adaptor, a power supply, or a transformer.

For example, the circuit board is a printed circuit board.

In an embodiment, the holding element is a circuit board with plural holes thereon.

In an embodiment, the holding element comprises a clip.

Preferably, the connecting element is a connecting wire.

In accordance with another aspect of the present invention, the electronic device comprises a circuit system disposed inside the electronic device, an opening disposed at a side of the electronic device, and a connector disposed in the opening. The connector comprises an isolation main body having a through hole and an opening, at least a conducting terminal disposed in the through hole and protruding out of the opening, a holding element extended from one end of the conducting terminal, and a connecting element having one end connected to the holding element, and the other end connected to the circuit system inside the electronic device so as to electrically connect the connector and the electronic device.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention relates to a connector and a connecting structure thereof that can be applied to an electronic device, such as an adapter, a power supply or a transformer. The connector of the present invention uses a holding element and a connecting element to electrically connect the conducting terminal with its applicative electronic device, so as to overcome the drawbacks of the connecting structure of the conventional connectors, and further reduce the manufacturing cost and increase the production yield. The embodiments below will further explain the details of the connector and the connecting structure thereof of the present invention, which is applied to an adapter for example. However, the present invention is not limited thereto and other techniques or designs applicable to the present invention are also incorporated herein for reference.

Figure 1A:
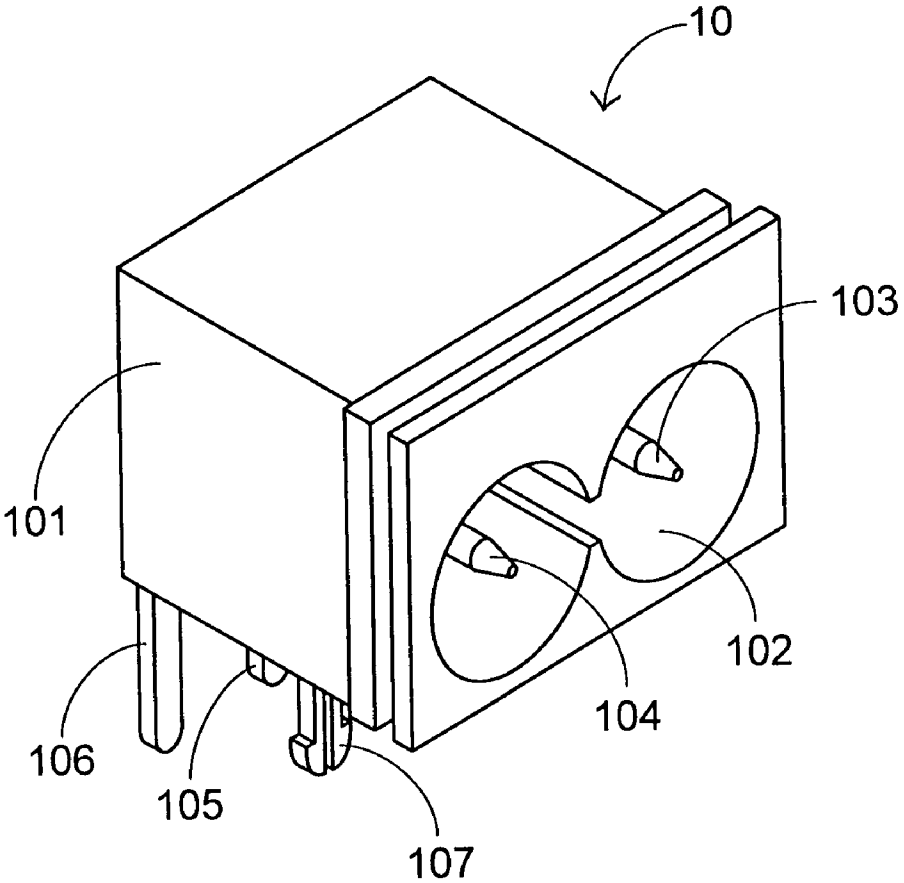
Fig. 1(a) (Prior Art)
FIGS. 1(*a*) and 1(*b*) are schematic views showing a conventional AC connector.
Figure 1B:
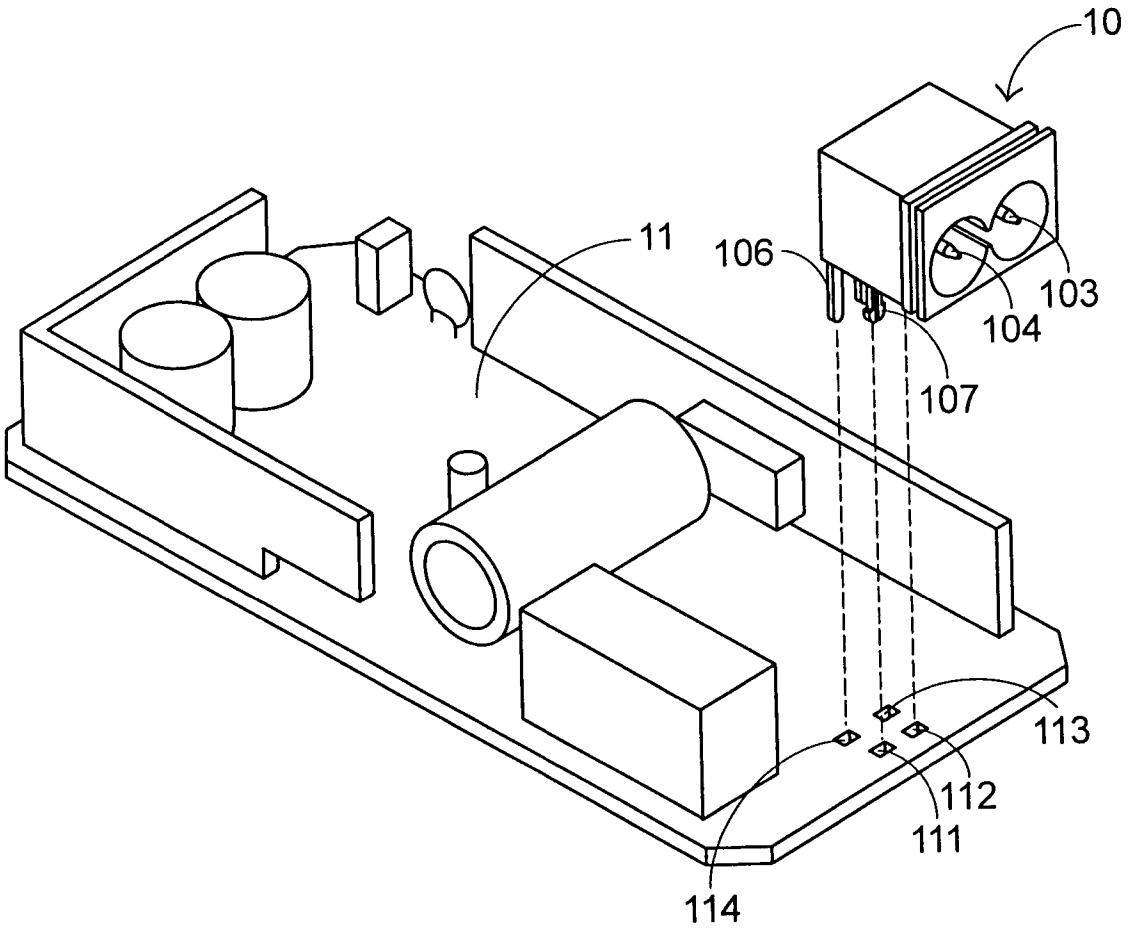
Fig. 1(b) (Prior Art)
Figure 2:
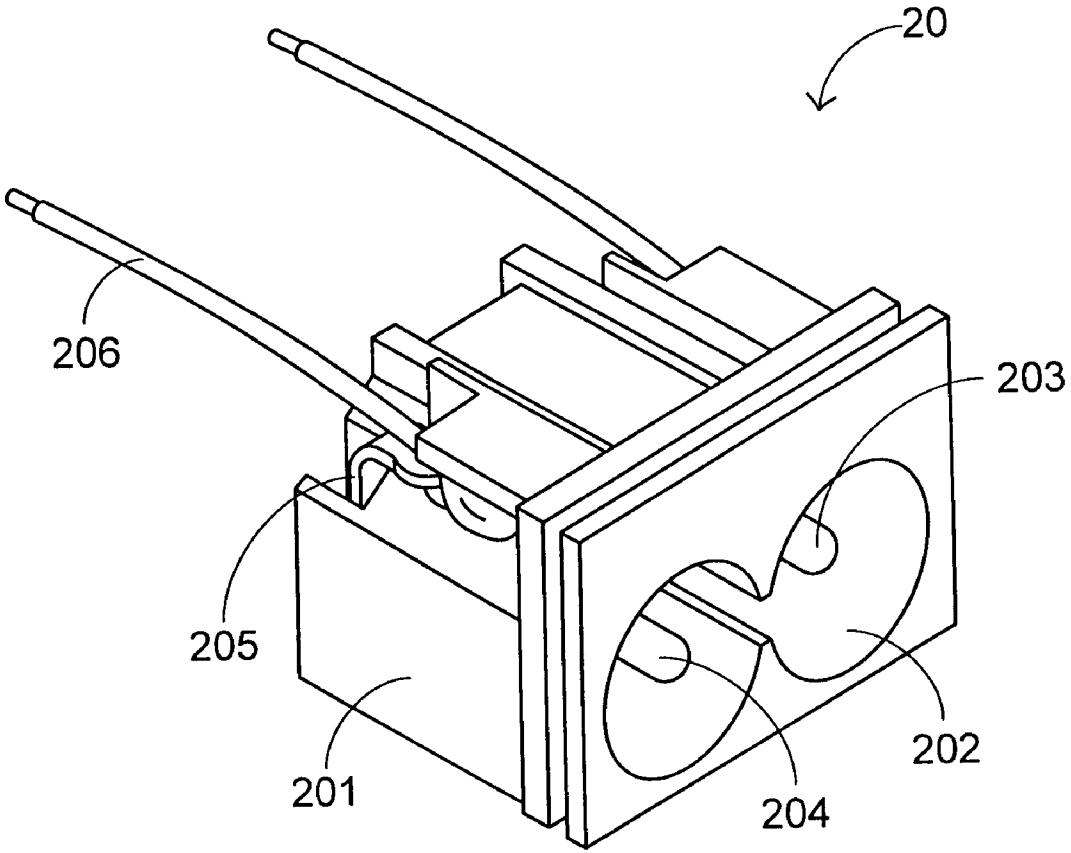
Fig. 2 (Prior Art)
FIG. 2 is a schematic view showing an AC connector in the market.
Figure 3:
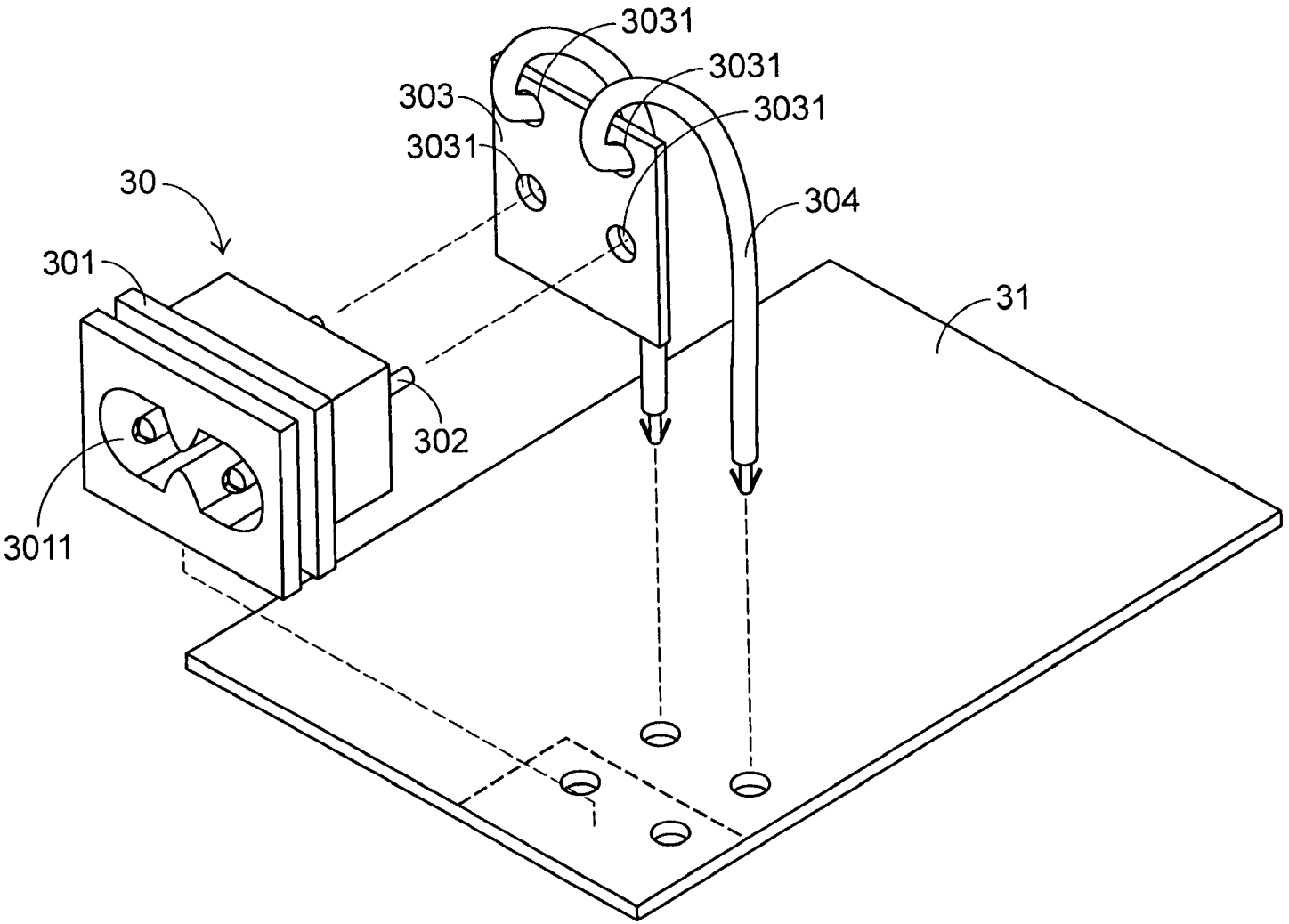
FIG. 3 is a schematic view showing the connector and the connecting structure thereof according to a first preferred embodiment of the present invention.

Please refer to FIG. 3, which is a schematic view showing the connector and the connecting structure thereof according to the first preferred embodiment of the present invention. As shown in FIG. 3, the connector and the connecting structure thereof 30 mainly comprises an isolation main body 301, a conducting terminal 302, a holding element 303 and a connecting element 304. The main body 301 has a through hole 3011 and an opening (not shown) at the rear of the main body 301 for receiving the conducting terminal 302 and allowing the conducting terminal 302 to protrude out of the opening. The holding element 303 is a circuit board and the conducting terminal 302 protruding out of the opening can be mounted directly into the corresponding hole 3031 of the holding element 303 and fixed therein. Moreover, the connecting element 304 is mounted into another hole 3031, and a welding process is performed on the holding element 303 on the surface facing backward the connector 30 to fix the conducting terminal 302 and the connecting element 304 thereon at the same time, and electrically connect the conducting terminal 302 and the connecting element 304. In addition, the other end of the connecting element 304 is connected to the circuit board 31 in the electronic device.

Obviously, according to the present invention, the conducting terminal needs not to be welded or riveted with the conducting piece or pin, and the holding element is used as a shelter to fix and electrically connect the conducting terminal and the connecting element thereon by welding on the surface that does not face the connector. Therefore, the structure of the isolation main body of the connector will not be influenced by the welding process. Furthermore, the present invention uses a connecting wire as a connecting element, so the problem of the narrow applicability of the connector can be solved, and the connector and the electronic device can be connected easily. Moreover, the holding element can further block the impedance interference between the connector and the electronic device and prevent the heat produced during the operation of the electronic device from being directly conducted to the connector and influencing the temperature of the connector.

Figure 4:
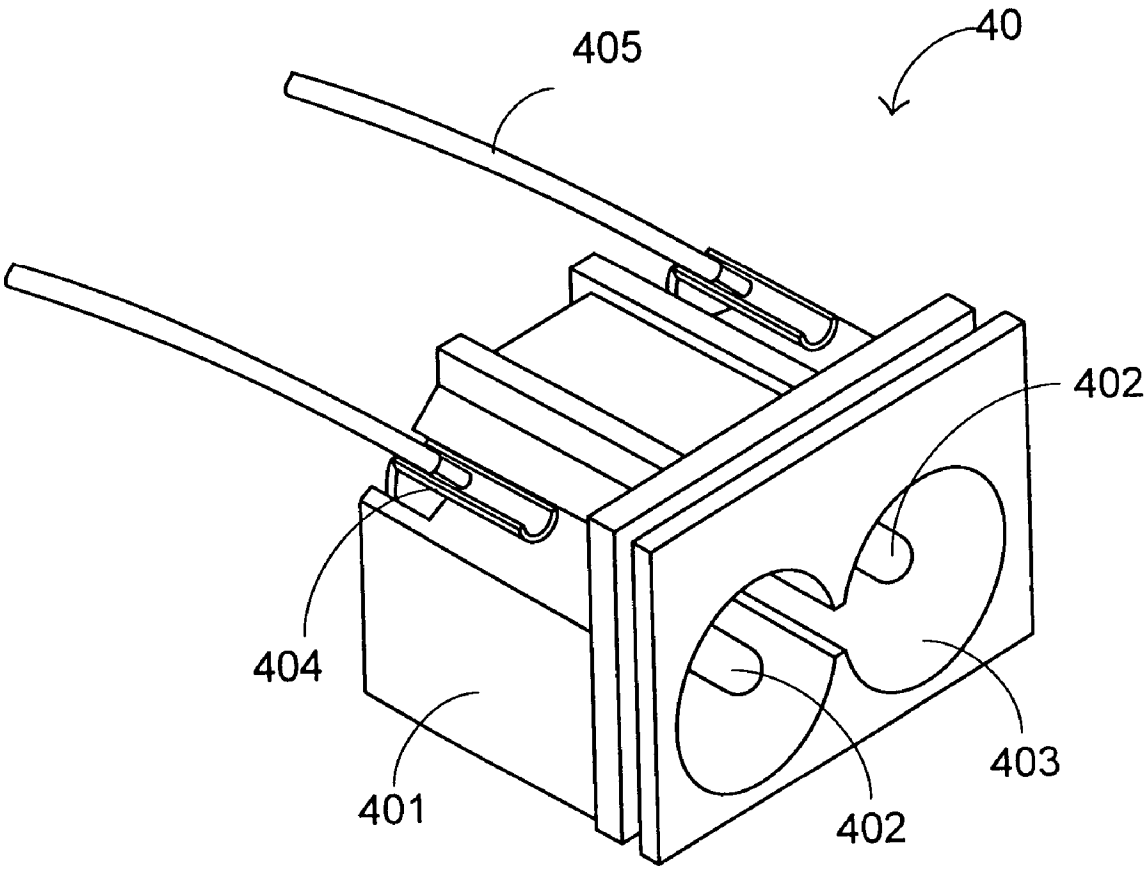
FIG. 4 is a schematic view showing the connector and the connecting structure thereof according to a second preferred embodiment of the present invention.

Certainly, the holding element of the present invention is not confined to the circuit board shown in the FIG. 3. Please refer to the FIG. 4, which is a schematic view showing the connector and the connecting structure thereof according to the second preferred embodiment of the present invention. As shown in FIG. 4, the holding element is connected with a connecting element 405 in advance, and the connecting element 405 is mounted and fixed in a clip 404 of the holding element. The conducting terminal 402 is mounted in the through hole 403 of the connector 40, and then riveted with the holding element 404. As a result, through the design of the clip 404 and the specific height of the holding element 404, the connecting element 405 can be electrically connected with the conducting terminal 402 firmly; besides, a preferred connector can be manufactured in the situation that the structure of the isolation main body 401 of the connector 40 is not affected.

In the embodiments of the present invention, the material of the conducting terminal is metal, and the metal is shaped into a solid stick-like form. Additionally, the shape, size, structure, and holding manner of the holding element are also not limited. The shapes of holes on the holding element as shown in the FIG. 3 can be varied in accordance with actual requirements as long as the conducting terminal can be surely fixed on the holding element.

In conclusion, the connector and connecting structure thereof of the present invention uses the conducting terminal to accomplish the assembling of the connector to the electronic device. In comparison with the prior art, the conducting piece or pin is not required, and the holding element can be used to extend the distance between the isolation main body and the welding or riveting position, so as to reduce the possible influences to the isolation main body of the connector caused by the welding or riveting process. Moreover, the holding element can be used to further block the impedance interference between the connector and the electronic device, and further prevent the heat produced during the operation of the electronic device from being directly conducted to the connector and influencing the temperature of the connector. Furthermore, according to the embodiments of the present invention, the connecting element can be securely fixed and protected, and the wiring area on the printed circuit board can even be enlarged to conform to the trend of minimizing the electronic device. Therefore, the present invention indeed possesses progressiveness and industrial value.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A connector and a connecting structure thereof, comprising:

an isolation main body having a through hole and an opening;

at least a conducting terminal disposed in said through hole and protruding out of said opening;

a holding element extended from one end of said conducting terminal, said holding element being a circuit board having a first hole and a second hole thereon; and a connecting element having one end connected to said holding element, and the other end connected to a circuit board in an electronic device;

wherein said conducting terminal and said connecting element are mounted directly into said first hole and said second hole of said holding element respectively.

2. The connector and the connecting structure thereof according to claim 1 wherein said electronic device is an adaptor.

3. The connector and the connecting structure thereof according to claim 1 wherein said electronic device is a power supply.

4. The connector and the connecting structure thereof according to claim 1 wherein said electronic device is a transformer.

5. The connector and the connecting structure thereof according to claim 1 wherein said circuit board is a printed circuit board.

6. The connector and the connecting structure thereof according to claim 1 wherein said connecting element is a connecting wire.

7. An electronic device, comprising:

a circuit system disposed inside said electronic device;

an opening disposed at a side of said electronic device; and a connector disposed in said opening and comprising:

an isolation main body having a through hole and an opening;

at least a conducting terminal disposed in said through hole and protruding out of said opening;

a holding element extended from one end of said conducting terminal, said holding element being a circuit board having a first hole and a second hole thereon; and a connecting element having one end connected to said holding element, and the other end connected to said circuit system inside said electronic device so as to electrically connect said connector and said electronic device;

wherein said conducting terminal and said connecting element are mounted directly into said first hole and said second hole of said holding element respectively.

8. The electronic device according to claim 7 wherein said electronic device is an adaptor, a power supply, or a transformer.

9. The electronic device according to claim 7 wherein said circuit system comprises a printed circuit board.

10. The electronic device according to claim 7 wherein said connecting element is a connecting wire.

* * * * *